US007955463B2

(12) United States Patent
Fischer et al.

(10) Patent No.: US 7,955,463 B2
(45) Date of Patent: Jun. 7, 2011

(54) METHOD FOR CONNECTING SHELL PARTS

(75) Inventors: Raphael Fischer, Schweinfurt (DE); Ralf Hund, Ruppertshofen (DE)

(73) Assignee: Schaeffler Technologies GmbH & Co. KG, Herzogenaurach (DE)

( * ) Notice: Subject to any disclaimer, the term of this patent is extended or adjusted under 35 U.S.C. 154(b) by 134 days.

(21) Appl. No.: 12/376,016

(22) PCT Filed: Jul. 28, 2007

(86) PCT No.: PCT/DE2007/001344

§ 371 (c)(1),
(2), (4) Date: Apr. 10, 2009

(87) PCT Pub. No.: WO2008/014767

PCT Pub. Date: Feb. 7, 2008

(65) Prior Publication Data

US 2010/0006212 A1 Jan. 14, 2010

(30) Foreign Application Priority Data

Aug. 2, 2006 (DE) ..... 10 2006 036 009

(51) Int. Cl.
*B32B 37/06* (2006.01)
*B23P 11/00* (2006.01)

(52) U.S. Cl. ..... 156/198; 156/216; 156/226; 156/227; 156/292; 29/243.58; 29/509; 29/513; 29/521

(58) Field of Classification Search ..... None
See application file for complete search history.

(56) References Cited

U.S. PATENT DOCUMENTS

| | | | | |
|---|---|---|---|---|
| 4,094,550 | A * | 6/1978 | Toal et al. | 301/37.24 |
| 4,441,241 | A * | 4/1984 | Hoeffken | 29/890.03 |
| 2008/0000071 | A1 * | 1/2008 | Chen et al. | 29/509 |

FOREIGN PATENT DOCUMENTS

| | | | |
|---|---|---|---|
| DE | 19856606 | | 6/2000 |
| DE | 19927207 | | 12/2000 |
| DE | 10028706 | | 12/2001 |
| DE | 10308521 | | 9/2004 |
| DE | 10331205 | | 1/2005 |
| EP | 0987166 | | 3/2000 |
| JP | 06246371 | | 9/1994 |
| JP | 07185675 | | 7/1995 |
| JP | 09057368 | | 3/1997 |
| JP | 10258331 | A * | 9/1998 |

* cited by examiner

*Primary Examiner* — Sam C Yao
(74) *Attorney, Agent, or Firm* — Volpe and Koenig, P.C.

(57) ABSTRACT

A method for connecting shell parts (01, 02), which have been formed from sheet metal, for example by deep drawing. The shell parts (01, 02) may be any desired workpieces of a chassis part in the form of semifinished items or other components that are suitable for a folded seam connection. For this, the shell parts must have edges which are arranged lying one against the other in the connecting position. The method according includes first arranging the shell parts (1, 2) that are to be connected in a position envisaged for the shell parts (01, 02) in the connected state. Subsequently, the edge (03) of the first shell part (01) is folded around the edge (04) of the second shell part (02), so that a folded seam (06) is formed. After the folding operation, according to the invention the folded seam (06) is heated and subsequently once again pressed together. As a result, a positive and gap-free folded seam connection is achieved, with which the shell parts (01, 02) are permanently firmly connected.

12 Claims, 2 Drawing Sheets

METHOD FOR CONNECTING SHELL PARTS

BACKGROUND

The invention relates to a method for connecting shell parts that were produced, for example, by a deep drawing method of a sheet metal.

Shell parts made from sheet metal have many uses, for example, in the construction of vehicle bodies. The connection of shell parts can be performed, e.g., by stamped rivets, by spot-weld connections, or by beading or folding the sheet metal edges.

From DE 100 28 706 A1a device for turning over a bead edge of a work piece through roller folding with a drivable tool unit is known. The tool unit is mounted rotatably, so that several working positions can be assumed. The device comprises several folding rollers that fold the work piece in several steps one after the other. The pressure exerted on the folding edge in the last folding stage defines the strength of the folded seam connection. It has been shown, however, that the strength of the folded seam connection that can be achieved with this and similar methods is not sufficient for many applications. Alternating load conditions lead to micro-movements between the connected work pieces. These micro-movements lead to material wear in the joint gap that initially damages the usually provided corrosion protection. This can lead to corrosive attack on the base material, so that the joint gap continues to become bigger and the folded seam connection finally detaches.

From DE 100 33 768 A1, a method for folding thin-walled semifinished products or components made from metallic material is known, wherein the material is brittle and/or hard to shape at room temperature. The material involves, in particular, aluminum, magnesium, and titanium alloys. In the solution, the region to be folded is heated. The strength that can be achieved in a folded seam connection with brittle materials, however, is limited.

From DE 103 31 205 A1, a device and a method for turning over a bead edge of a work piece through roller folding is known. This solution is distinguished in that a heating device is provided that heats at least one region of the bead edge currently to be folded directly or indirectly during a folding process. An adhesive arranged in the folded seam of the work piece is thickened by the applied heat. In this way, the processes of folding and thickening usually performed one after the other are combined into one work cycle. Furthermore, the heating of the work piece simplifies the shaping, because the molecular lattice structure can be more easily adapted to deformation under the application of heat. The strength of the folded seam connection is defined, in particular, by the properties of the adhesive. In so far as no adhesives are used, the strength that can be achieved with this solution is in turn limited by the pressure on the bead edge that can be achieved by the rollers.

SUMMARY

The objective of the present invention is to provide a method for connecting shell parts with which a permanently rigid connection can be achieved through folding or beading of a partial edge of the shell, while avoiding the disadvantages known from the state of the art.

This objective is met by a method according to the accompanying independent claim.

The method according to the invention initially involves the arrangement of the shell parts to be connected in a position that is provided for the shell parts in the connected state.

The shell parts can involve arbitrary work pieces of chassis parts, in particular, wheel carriers and/or pivot supports, in the form of semifinished products or other components that are suitable for a folded seam connection. Here, the shell parts must have edges that are arranged with one contacting the other in the connection position.

Then the edge of the first shell part is folded around the edge of the second shell part, so that a folded seam is formed. The folded seam is heated according to the invention and then compressed. Here, a positive-fit and gap-free folded seam connection is achieved.

One special advantage of the method according to the invention is that it prevents a so-called kickback of parts to be processed or formed that occurs in the typical method, wherein a tighter positive-fit connection and/or higher dimensional accuracy—especially for the construction of a tight joint gap—is realized by the invention in the parts to be processed. This result is traced back to the fact that in the heating according to the invention for the parts to be processed, an elastic range of the parts is reduced so far that the parts are in the plastic range during processing. Then the deformation essentially remains after the load is removed after the compression.

Another special advantage of the method according to the invention is provided in that it can also be used for connecting shell parts that were previously connected with a method for creating a folded seam connection according to the state of the art. Therefore, no change in the production or shaping of the shell parts is required, in order to be able to apply the method according to the invention. Optionally, the edges used for the connection according to the invention can be constructed narrower than those for a connection according to the state of the art, because a higher strength of the folded seam connection can be achieved by the method according to the invention.

Preferably, the edges of the shell parts are constructed so that the edge of the first shell part is arranged overlapping relative to the edge of the second shell part. For the folding, only the edge of the first shell part is folded, while the edge of the second shell part essentially maintains its shape.

It can be further provided that the edges are profiled together with corresponding profiles, for example, a groove-like shape, producing a greater positive-fit connection—especially suitable for thrust and/or shear loads.

These embodiments of the invention are optimal for most applications with respect to the arrangement of the edges, because only a short edge is required on the second shell part and only the first shell part is to be folded. However, the invention can also be constructed for other types of arrangements of the edges of the shell parts. For example, the edges of the two shell parts could be arranged so that they are closed flush, or so that they are folded in common.

Advantageously, when the folded seam is heated, both the edge of the first shell part and also the edge of the second shell part are heated. In this way, it is guaranteed that the edges of both shell parts experience an increased effect of the compression process due to the heating.

Advantageously, the folded seam is heated at least up to a given deformation temperature, in particular, a temperature above 700° C. Through heating of the folded seam up to the named deformation temperature, it is guaranteed that the compression can achieve deformation like for hot forging. Such deformation of the edges of the shell parts can be compared with a shaping process.

Advantageously, during the compression a force is achieved in which at least the surface of the edge of the first shell part in contact with the edge of the second shell part can be deformed plastically. In this way it is guaranteed that the surface of the edge of the first shell part can be adapted completely to the unevenness of the contact surface, so that any gaps present there are filled by material of the edge of the first shell part.

In one preferred embodiment of the invention, the heated folded seam is cooled in an accelerated way after the compression with a suitable means for cooling. In this way, the method according to the invention has the advantages of press hardening in which the strength of the material, in particular, its tensile strength, is increased significantly.

In another preferred embodiment of the invention, a joining material, in particular, an adhesive selected under consideration of the deformation temperature, is deposited between and/or on the edges of the shell parts before the folding. The joining material is spread in the folded seam after the folding and permanently supports the folded seam connection after the curing. The joining material can also be used for increasing the tightness of the folded seam connection.

BRIEF DESCRIPTION OF THE DRAWINGS

Additional advantages, details, and improvements of the invention emerge from the following description of several embodiments with reference to the drawings.

Shown are.

DETAILED DESCRIPTION OF THE PREFERRED EMBODIMENTS

Figure 1A:
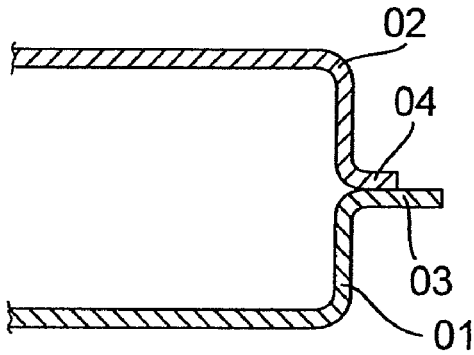
FIGS. 1*a, b, c* views showing a construction of the method according to the invention and FIGS. 2*a, b* two views of an example application of the method according to the invention on a pivot support.
Figure 1B:
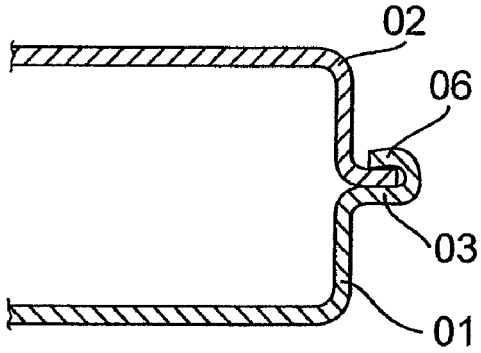
Figure 1C:
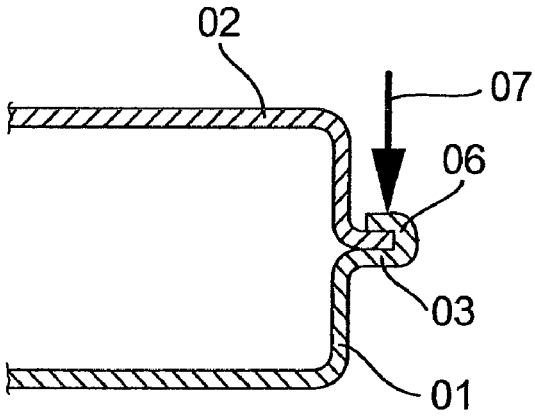

FIG. 1 shows three phases in the sequence of a preferred embodiment of the method according to the invention. FIG. 1*a* shows two shell parts to be connected, after these were positioned. FIG. 1*b* shows the two shell parts after a folding process. FIG. 1*c* shows the two shell parts after a compression process.

FIG. 1*a* shows a sectional view of a first shell part 01 and a second shell part 02 that are to be connected at a folded seam connection. The shell parts 01, 02 are made from sheet steel. The first shell part 01 has an angled, foldable edge 03. The second shell part 02 likewise has an angled edge 04. The edge 03 of the first shell part 01 is wider than the edge 04 of the second shell part 02. The shell parts 01, 02 are arranged so that their edges 03, 04 contact each other, wherein the edge 03 of the first shell part 01 overlaps the edge 04 of the second shell part 02. Such an arrangement can be produced across the entire peripheral region of the shell parts. Such an arrangement must be produced at least in the sections of the shell parts 01, 02 in which the shell parts 01, 02 are to be connected.

FIG. 1*b* shows the shell parts 01, 02, after the edge 03 of the first shell part 01 was folded. This folding process can be performed with a special folding tool. Different folding tools from the state of the art are known. For example, drivable roller tools with which the folding process is constructed stage by stage are suitable for many applications. The folding of the edge 03 of the first shell part 01 can also be realized by a manual beading of the edge. The folding can also be prepared during the production of the first shell part 01 so that its edge 03 is already angled by 90° at the folding line. The folding is advantageously performed in the cold state, when the shell parts 01, 02 including their edges 03, 04 are at room temperature. In other embodiments, however, the edges 03, 04 can also already be heated, in order to simplify the folding.

The edge 03 of the first shell part 01 is folded around the edge 04 of the second shell part 02. This can be realized, for example, by rolling (continuous) folding—or instead by individual strokes step by step.

Consequently, the edge 04 of the second shell part 02 is not or just barely deformed. At least no intentional deformation of the edge 04 of the second shell part 02 is performed, wherein a few applications can lead to slight bending or the like, which does not, however, represent a negative effect.

After the folding of the edge 03 of the first shell part 01, a folded seam 06 is constructed. The folded seam 06 does not yet have to be compressed with a high pressure during this step of the method according to the invention. The folded seam 06 does not yet have the final strength required for the connection of the shell parts 01, 02. Also, within the folded seam 06, gaps or the like can still be present. The part of the edge 03 of the first shell part 01 deformed by the folding has an approximately semicircular cross section.

FIG. 1*c* shows the shell parts 01, 02, after the folded seam 06 was compressed. Before the beginning of the compression process, the folded seam 06 is heated. For the heating of the folded seam 06, various different means can be used. For example, hot-air fans, burners, or inductive heating devices can be used. Through the heating, the edge 03 of the first shell part 01 and also the inner edge 04 of the second shell part 02 are heated.

The heated folded seam 06 is compressed after the heating with a high force that is symbolized by an arrow 07 in FIG. 1*c*. The force 07 is directed onto the folded seam 06 so that it acts between the outside of the non-deformed part of the edge 03 of the first shell part 01 and the outside of the folded part of the edge 03 of the first shell part 01. Consequently, the force 07 is oriented perpendicular to the edge 04 of the second shell part 02. Because the folded seam 06 is heated, the folded seam 06 can be slightly deformed. In particular, the folded seam 06 is deformed in the region of the folded seam edge formed by the folding, because there the compression force is increased by a lever effect. The folded part of the edge 03 of the first shell part 01 now has, instead of the previously mentioned semicircular cross section, a flat section parallel to the edge 04 of the second shell part 02 and also a section with a flush folded seam edge. Through the compression, the edge 04 of the second shell part 02 is clamped with a greater strength in the folded seam 06.

The deformation achieved by the compression, especially for the folded part of the edge 03 of the first shell part 01, is further generated so that the contacting surfaces of the edges 03, 04 of the shell parts 01, 02 contact each other tightly and without gaps or other intermediate spaces. Due to this surface construction of the folded seam connection, a permanently high strength is guaranteed. It is prevented that only sections or only edges of the folded part of the edge 03 of the first shell part 01 lie on the edge 04 of the second shell part 02.

Figure 2A:
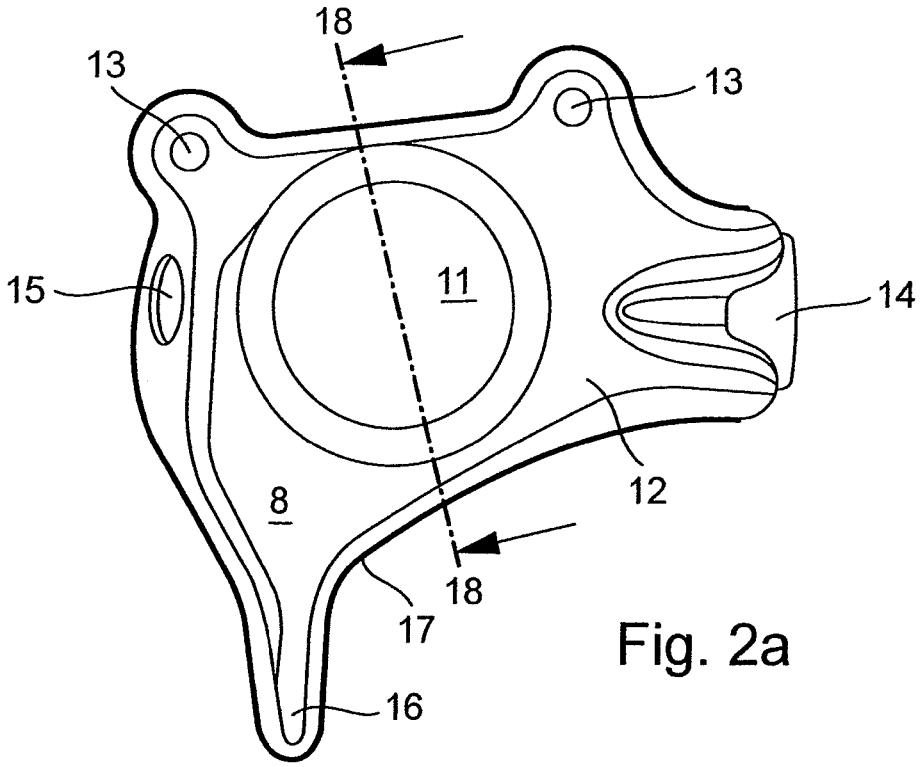

FIG. 2*a* shows a top view onto a pivot support 12 with visible top shell 8 and peripheral bead edge 17, wherein the visible top shell 8 is connected to a bottom shell that is not visible in FIG. 2*a* by a folded seam 10 realized according to the method according to the invention.

Figure 2B:
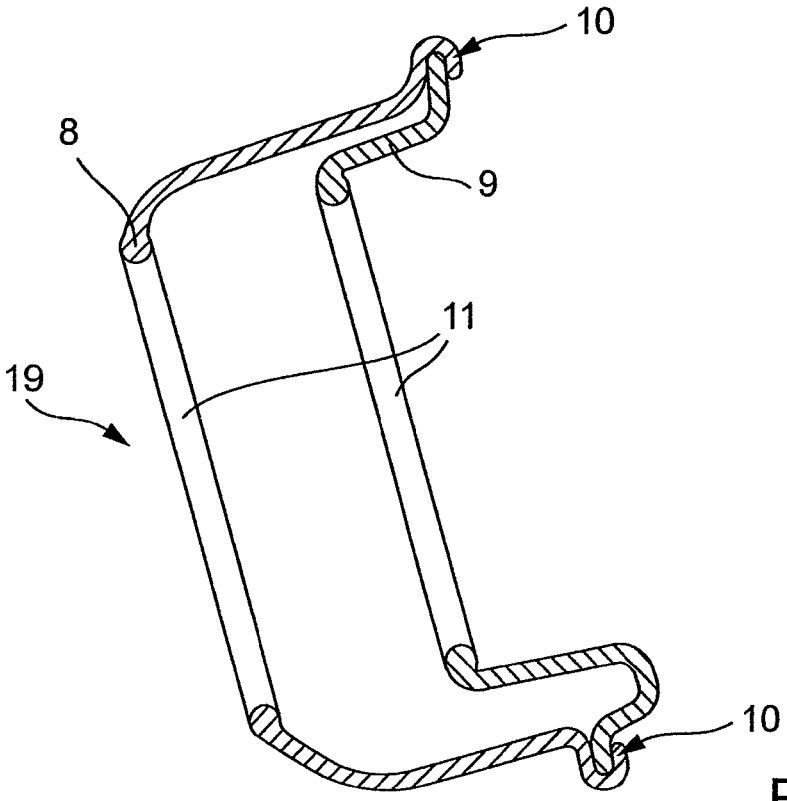

FIG. 2*b* shows a section through the pivot support 12 as indicated 18 in FIG. 2*a*. Here, FIG. 2*b* shows the sectioned top shell 8 and the sectioned bottom shell 9 and also the sectioned folded seam 10 through which the top shell 8 and bottom shell 9 are connected according to the method according to the invention. FIG. 2*b* further shows a borehole 11 for holding the wheel bearing 19 (not shown).

LIST OF REFERENCE SYMBOLS

01 First shell part
02 Second shell part

03 Edge of the first shell part
04 Edge of the second shell part
05 -
06 Folded seam
07 Force for compression
08 Top shell
09 Bottom shell
10 Folded seam
11 Borehole
12 Pivot support
13 Brake connection
14 Spring leg holder
15 Transverse control arm connection
16 Steering tie rod connection
17 Bead edge
18 Indication of section
19 Wheel bearing

The invention claimed is:

1. Method for connecting a first shell part of a chassis part with a second shell part of the chassis part comprising the following steps:

first, positioning the shell parts in a position to be achieved by the connection, wherein a foldable edge of the first shell part is arranged on one edge of the second shell part, next, folding the edge of the first shell part around the edge of the second shell part, after folding, heating a folded seam created by the folding, and after heating, compressing the heated folded seam, wherein the folded seam is heated to a deformation temperature that is above 700° C.

2. Method according to claim 1, wherein the foldable edge of the first shell part is arranged overlapping opposite the edge of the second shell part, and the edge of the second shell part essentially maintains its shape during the folding step.

3. Method according to claim 1, wherein during the heating of the folded seam, the edge of the first shell part and the edge of the second shell part are heated.

4. Method according to claim 1, wherein the edges of the shell parts are profiled together with corresponding profiles.

5. Method according to claim 1, wherein the compressing is performed with a force through which at least a surface of the edge of the first shell part contacting the edge of the second shell part is deformed plastically.

6. Method according to claim 1, wherein the shell parts, including the edges are at room temperature during the folding.

7. Method according to claim 1, wherein the folded seam is cooled in an accelerated manner after the compressing.

8. Method according to claim 1, wherein a joining material is deposited between and/or on the edges of the shell parts before the folding.

9. Method according to claim 1, wherein the chassis part is a wheel carrier or pivot support.

10. Method according to claim 1, wherein at least one of the first shell part or the second shell part is suitable for holding at least one of a wheel bearing, connection elements to a chassis, or a brake.

11. Method according to claim 10, wherein the connection elements comprise at least one of a steering tie rod holder, a spring leg or a spring damper element.

12. Method according to claim 8, wherein the joining material is an adhesive.

* * * * *